US006732660B2

(12) United States Patent
Dame et al.

(10) Patent No.: US 6,732,660 B2
(45) Date of Patent: May 11, 2004

(54) MODULAR WORKSTATION

(75) Inventors: Paul Dame, Holland, MI (US); Toren Orzeck, Portland, OR (US)

(73) Assignee: Herman Miller, Inc., Holland, MI (US)

( * ) Notice: Subject to any disclaimer, the term of this patent is extended or adjusted under 35 U.S.C. 154(b) by 109 days.

(21) Appl. No.: 09/977,044

(22) Filed: Oct. 12, 2001

(65) Prior Publication Data

US 2002/0069794 A1 Jun. 13, 2002

Related U.S. Application Data

(60) Provisional application No. 60/240,534, filed on Oct. 13, 2000.

(51) Int. Cl.[7] ..... A47B 37/00

(52) U.S. Cl. ..... 108/50.01; 312/223.6; 108/50.02

(58) Field of Search ..... 108/50.01, 50.02, 108/60, 61; 312/223.6, 195; 211/180, 184

(56) References Cited

U.S. PATENT DOCUMENTS

| | | | | | |
|---|---|---|---|---|---|
| 1,471,247 | A | | 10/1923 | Dietz | |
| 1,532,064 | A | | 3/1925 | Neiswender | |
| 3,117,533 | A | * | 1/1964 | Martland | 108/60 |
| 3,463,505 | A | | 8/1969 | German et al. | |
| 3,588,210 | A | * | 6/1971 | Des Marais | 108/60 |
| 3,770,334 | A | | 11/1973 | Weber | |
| 4,094,256 | A | | 6/1978 | Holper et al. | |
| D266,467 | S | | 10/1982 | Ylänkö | |
| 4,612,863 | A | | 9/1986 | Vonhausen et al. | |
| 4,625,633 | A | | 12/1986 | Martin | |
| 4,719,663 | A | | 1/1988 | Termini | |
| 4,879,955 | A | | 11/1989 | Moll et al. | |
| 5,044,135 | A | | 9/1991 | Kroon et al. | |
| 5,160,188 | A | | 11/1992 | Rorke et al. | |
| 5,226,705 | A | | 7/1993 | Rorke et al. | |
| 5,237,935 | A | | 8/1993 | Newhouse et al. | |
| 5,522,324 | A | * | 6/1996 | van Gelder et al. | 108/50.02 |
| D372,811 | S | | 8/1996 | Muller-Deisig et al. | |
| 5,606,919 | A | * | 3/1997 | Fox et al. | 108/50.02 |
| 5,624,312 | A | | 4/1997 | Collier | |
| 5,660,120 | A | * | 8/1997 | Sims | 108/60 |
| 5,673,632 | A | * | 10/1997 | Sykes | 108/121 |
| 5,704,298 | A | | 1/1998 | Corpuz, Jr. et al. | |

(List continued on next page.)

FOREIGN PATENT DOCUMENTS

EP 0563850 A1 * 3/1993

OTHER PUBLICATIONS

IDEA home office workstation; http://www.ikea–usa.com/rooms_ideas/workhome_workstation.asp.

*Primary Examiner*—Jose V. Chen
(74) *Attorney, Agent, or Firm*—Brinks Hofer Gilson & Lione

(57) ABSTRACT

In a preferred embodiment, a workstation kit includes a support column having a partially open end, an easily accessible interior cavity, and a number of openings in the column's outer surface allowing utilities to be run within the column to the workstation. The support column has a plurality of holes around its periphery allowing the easy addition of a variety of workstation components in a number of different configurations providing a workstation with high modularity. Another component of the workstation kit is a cap defined by a vertical cavity and attaching to a partially open end of the support column allowing utilities to be run into the column and additionally providing a handle. An accessory includes a retractable privacy screen which attaches to the column. Methods for reconfiguring a workstation kit and for wiring a workstation are provided. Additionally, methods for attaching and detaching a retractable privacy screen are provided. Finally, a method of moving a workstation is provided.

29 Claims, 23 Drawing Sheets

U.S. PATENT DOCUMENTS

| | | | | | |
|---|---|---|---|---|---|
| D398,166 | S | | 9/1998 | Mitchell | |
| D400,730 | S | | 11/1998 | Brandenberg | |
| D401,440 | S | | 11/1998 | Brandenberg | |
| 5,833,332 | A | | 11/1998 | Marshall et al. | |
| 5,901,513 | A | * | 5/1999 | Mollenkopf et al. | 108/50.02 |
| 5,931,103 | A | | 8/1999 | Huang | |
| 5,934,639 | A | | 8/1999 | Chiang et al. | |
| 5,960,615 | A | | 10/1999 | Meetze | |
| 6,062,147 | A | * | 5/2000 | Footitt et al. | 108/60 |
| 6,076,903 | A | * | 6/2000 | Vander Park | 108/50.02 |
| 6,101,954 | A | * | 8/2000 | Rein et al. | 108/50.02 |
| 6,146,046 | A | * | 11/2000 | Oberle | 108/50.02 |
| 6,196,140 | B1 | * | 3/2001 | Newhouse et al. | 108/50.01 |
| 6,202,567 | B1 | * | 3/2001 | Funk et al. | 108/50.02 |
| 6,267,064 | B1 | * | 7/2001 | Ostertag et al. | 108/50.02 |
| 6,397,762 | B1 | * | 6/2002 | Goldberg et al. | 108/50.02 |

* cited by examiner

MODULAR WORKSTATION

This application claims the benefit of U.S. provisional application serial No. 60/240,534, filed Oct. 13, 2000, the entire disclosure of which is hereby incorporated by reference.

BACKGROUND

The present invention relates generally to workstations and workstation components, and in particular, to an easily reconfigurable workstation kit having various components including a column and cap having various openings allowing for easy wiring and handling of the workstation, an easily attached retractable screen, and to methods for uses thereof.

Workstations often are manufactured in one prototypical configuration to accommodate an accessory in one position. Typically, workstation support frames are solid members. Such support frames are frequently attached to the workstation's worksurface at a height meant to accommodate the average user. Utility wiring of most workstations usually runs up the back of the workstation. Most often, workstations are designed without handles. Additionally, workstations are often designed for use in wide-open spaces.

Conventional workstations and workstation components are often difficult to reconfigure, wire, and handle. Moreover, conventional workstations often lack privacy.

SUMMARY

In one aspect, this invention provides a workstation kit made up of components which are easy to install, easy to access, and easy to reconfigure in order to form a wide variety of workstation configurations enabling the user to configure the workstation to meet the user's individual needs. One of the components of the workstation kit is a support column having a partially open end, an easily accessible interior cavity, and a number of openings in the column's outer surface allowing utilities to be run within the column to the workstation. Additionally, the support column has a plurality of holes around its periphery allowing the addition of workstation components in a number of different configurations.

Another component of the workstation kit is a cap which is defined by a cavity running vertically therethrough, and which is designed to fit over the partially open end of the support column. The vertically running cavity within the cap allows utilities to be run into the support column and additionally provides a handle for the workstation.

One accessory which can be easily installed to the workstation is a retractable screen which provides the user with a measure of privacy. The screen has a number of hinged frame members allowing retraction of the screen and attaches vertically to the workstation column.

In another aspect of this invention, a workstation includes a workstation component, an elongated and vertically extending support column attached to the workstation component having a substantially hollow portion defining an interior cavity and having a plurality of openings communicating between an exterior of the column and the interior cavity, wherein said plurality of openings are formed vertically along at least a portion of a length of the column, and wherein the openings are accessible to the user.

It is another aspect of this invention to provide a workstation comprising a workstation component, an elongated and vertically extending support column defined by a partially open top end, and a cap attached to the column's partially open top end.

It is yet another aspect of this invention to provide a workstation comprising a workstation component, an elongated and vertically extending support column attached to the workstation component, and a privacy screen attached to the support column.

In another aspect of this invention, a preferred embodiment of the workstation kit comprises a support leg and support arm attached to a support column, and a worksurface attached to the support arm, whereby the support column, support leg, support arm, and worksurface are easily configurable to a number of workstation alignments having a varying number of columns, legs, arms, and worksurfaces.

In another aspect, a method for reconfiguring a workstation kit is provided. The provided workstation comprises a support column, a support leg attached to the support column, a support arm attached to the support column, and at least one worksurface attached to the support arm, whereby the workstation is configurable to form a plurality of workstation alignments having a varying number of support columns, support legs, support arms, and worksurface positions. The method comprises attaching a worksurface to a support column to form a first workstation configuration, detaching the worksurface from the support column, and reattaching the worksurface to the support column in a different configuration to form a second workstation configuration.

In yet another aspect, a method for wiring a workstation is provided. The provided workstation comprises a workstation component; and at least one elongated and vertically extending support column attached to the workstation component, the support column having a substantially hollow portion defining an interior raceway, and having a plurality of vertically spaced openings formed within the hollow support column, the plurality of openings within the hollow support column adapted to receive wiring allowing easy wiring access to the raceway, the raceway adapted to receive wiring running within the hollow support column. The method comprises inserting wiring into one of the plurality of openings formed within the support column, running the wiring through the raceway formed within the support column, and pulling the wiring through a different one of the plurality of openings within the support column.

In an additional aspect, a method for deploying a retractable privacy screen to a workstation is provided. The provided workstation comprises a workstation component; an elongated and vertically extending support column attached to the workstation component; and at least one retractable privacy screen attached to the support column in a folded up position, wherein the retractable privacy screen comprises a sheet material web, and a plurality of frame members, wherein each of frame member comprises a distal end and a proximal end, wherein the proximal ends are coaxially attached, and wherein the sheet material web is attached to the frame members. The method comprises extending the retractable privacy screen from a folded up position to a folded down position; and then disextending the privacy screen from a folded down position to a folded up position.

In yet another aspect, a method of moving a workstation is provided. The provided workstation comprises at least one hollow support column having a partially open top end, and at least one cap having at least one opening within the cap, wherein the cap is attached to the partially open top end of the column, and the opening within the cap allows the workstation to be gripped. The method comprises gripping the workstation through the opening within the cap and moving the workstation from a first location to a second location.

The present invention provides significant advantages over other workstations and workstation components. For example, the unique column allows easy wiring of the workstation. Likewise, the configuration of the column allows the workstation to be highly modular. Additionally, the column cap further provides wiring access to the workstation and additionally acts as a handle. Finally, an added benefit is the use of a retractable privacy screen accessory.

The present invention, together with further objects and advantages, will be best understood by reference to the following detailed description taken in conjunction with the accompanying drawings.

DETAILED DESCRIPTION OF THE PRESENTLY PREFERRED EMBODIMENTS

Figure 1:
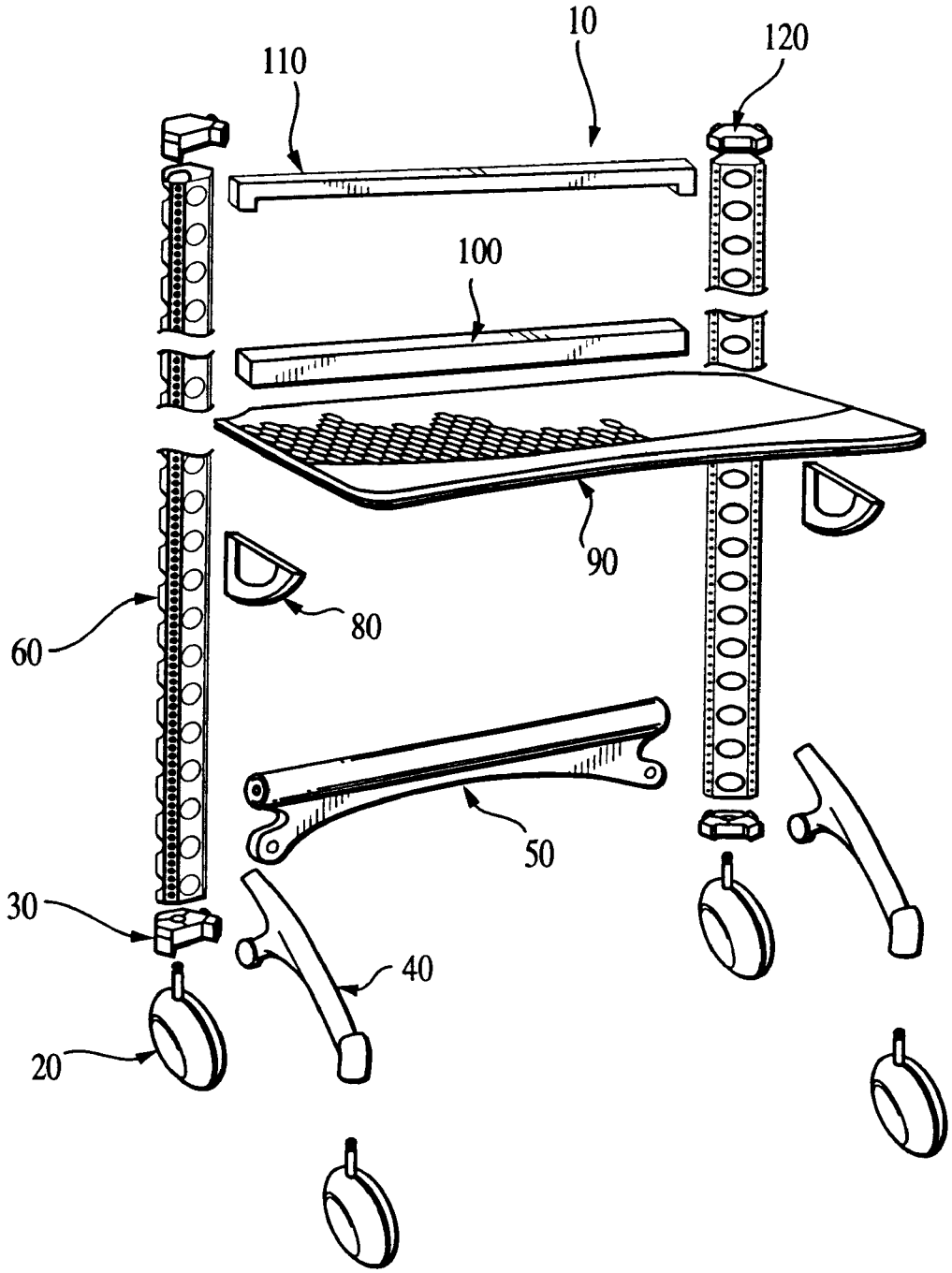
FIG. 1 is a perspective view of a modular workstation.

Referring to the drawings and as best shown in FIG. 1, a preferred embodiment of a modular workstation 10 includes a plurality of wheels 20 shown in this embodiment as having four, at least one ankle casting connection 30 shown in this embodiment as having two, a plurality of feet 40 shown in this embodiment as having two, at least one base cross member 50 shown in this embodiment as having one, at least one column 60 shown in this embodiment as having two, a plurality of arms 80 shown in this embodiment as having two, at least one desktop attachment 90 shown in this embodiment has having one, at least one cable tray 100 shown in this embodiment as having one, at least one backing support member 110 shown in this embodiment as having one, and at least one column cap 120 shown in this embodiment as having two.

Figure 2:
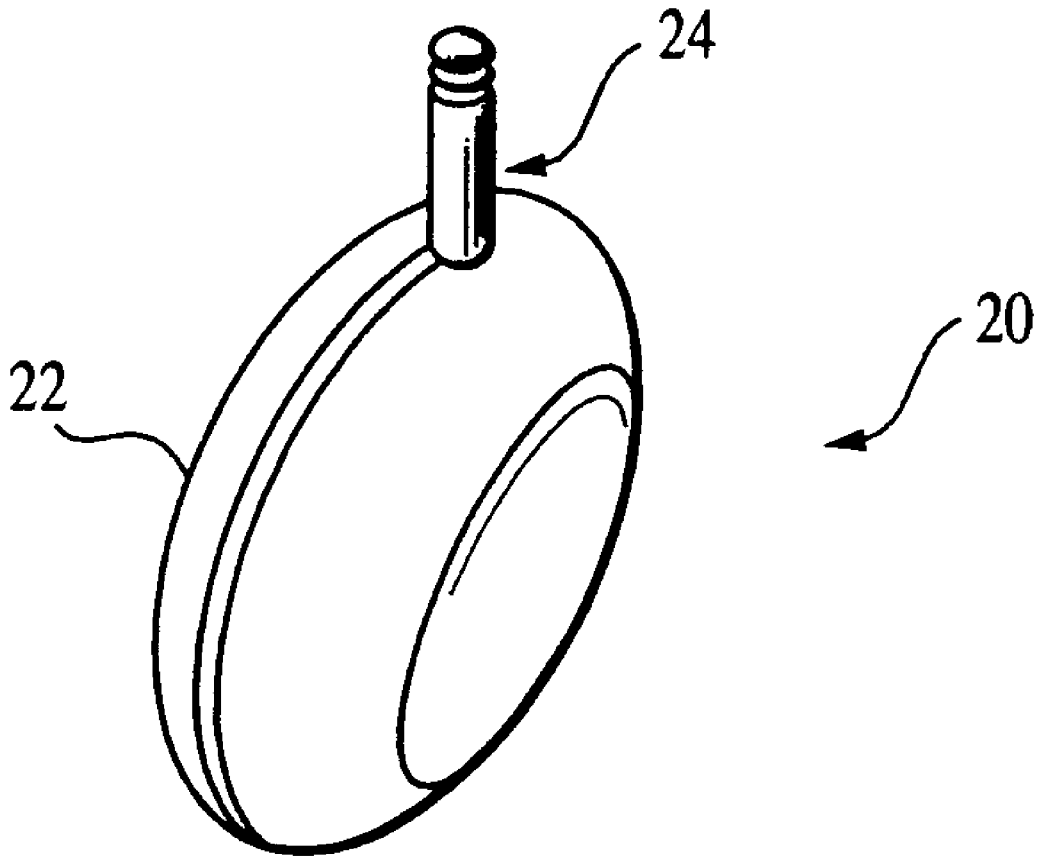
FIG. 2 is a side view of a workstation wheel.

As shown in FIG. 2, each wheel 20 has both a wheel portion 22 and a stem portion 24. The wheels are preferably rubber, but may be a variety of materials.

Figure 3:
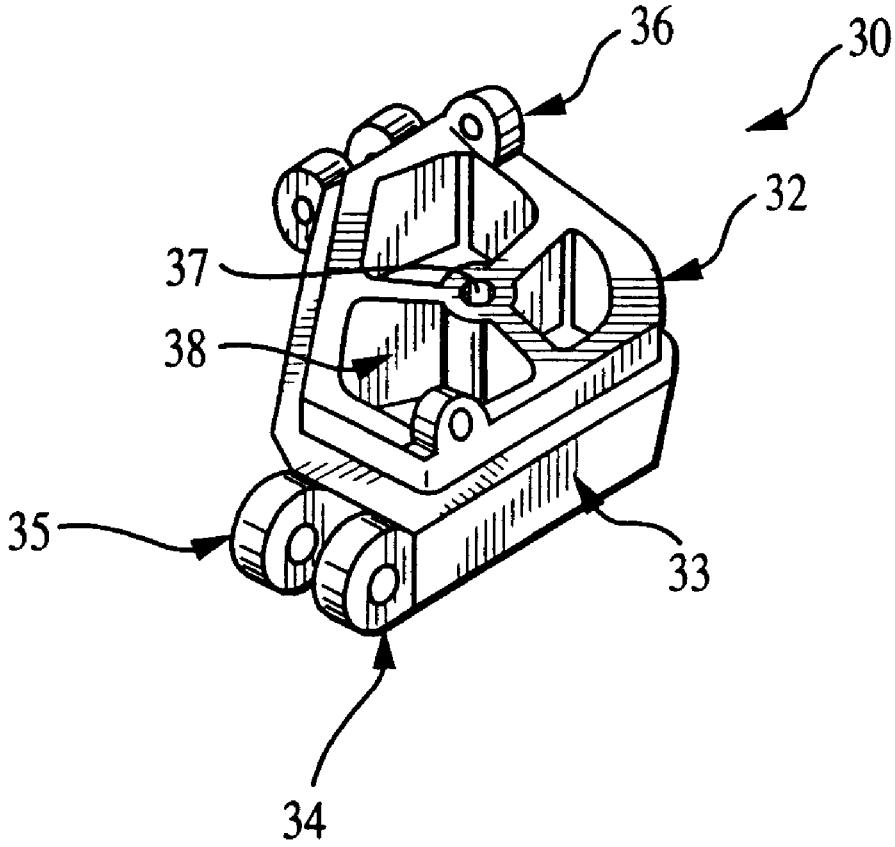
FIG. 3 is a perspective view of a workstation ankle casting.

Referring to FIG. 3, each ankle casting 30 has an upper surface 32, a side surface extending completely around its periphery 33, and a bottom surface 34. The cross-section of the ankle casting may be any shape but is preferably the same shape as the cross-section of the column 60 for easy attachment. For attaching to the workstation, bolt-receiving segments 35 extend outwardly from the side surface 33. Likewise, for attaching to the workstation, bolt-receiving segments 36 extend upwardly from the upper surface 32. To accommodate the stem portions 24 of the wheels, a socket 37 runs vertically from the bottom surface 34 to the upper surface 32. For accommodating wiring, open channels 38 run vertically from the bottom surface 34 to the upper surface 32. The ankle castings are preferably aluminum, but may be a variety of materials including steel and plastic.

Figure 4:
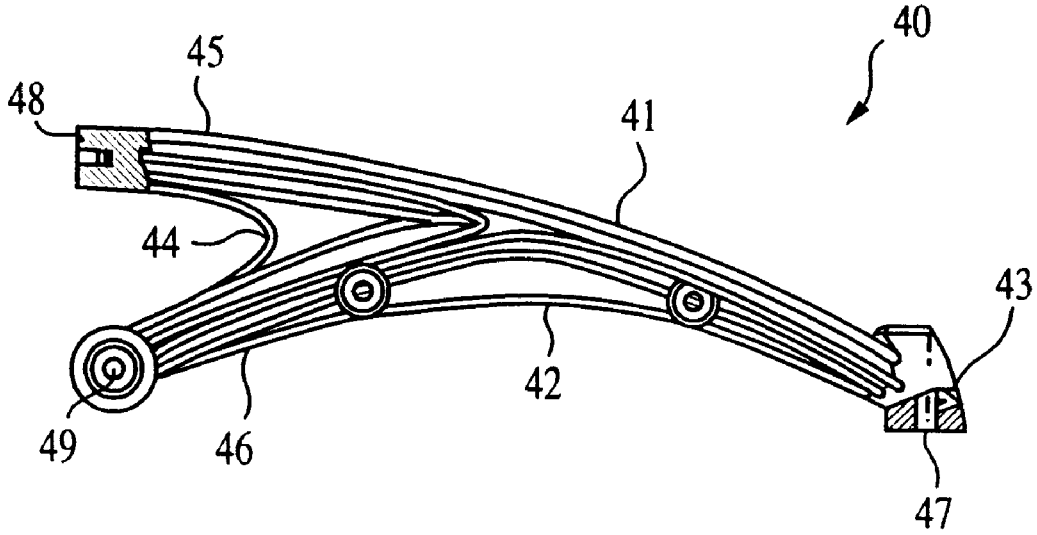
FIG. 4 is a side view of a workstation foot.

Referring to FIG. 4, each foot 40 is one piece, has a top end 41, a bottom end 42, a front end 43, and a back end 44. As shown, the back end 44 splits into two portions, an upper portion 45 and a lower portion 46. For attaching to the wheel 20, the front end 43 has a vertically running socket 47. For attaching to the workstation, the upper portion 45 of the back end 44 contains a horizontally running socket 48 and the lower portion 46 of the back end 44 contains a horizontally running bolt-receiving hole 49. Each foot is preferably aluminum but may also be a variety of materials including steel and plastic.

Figure 5:
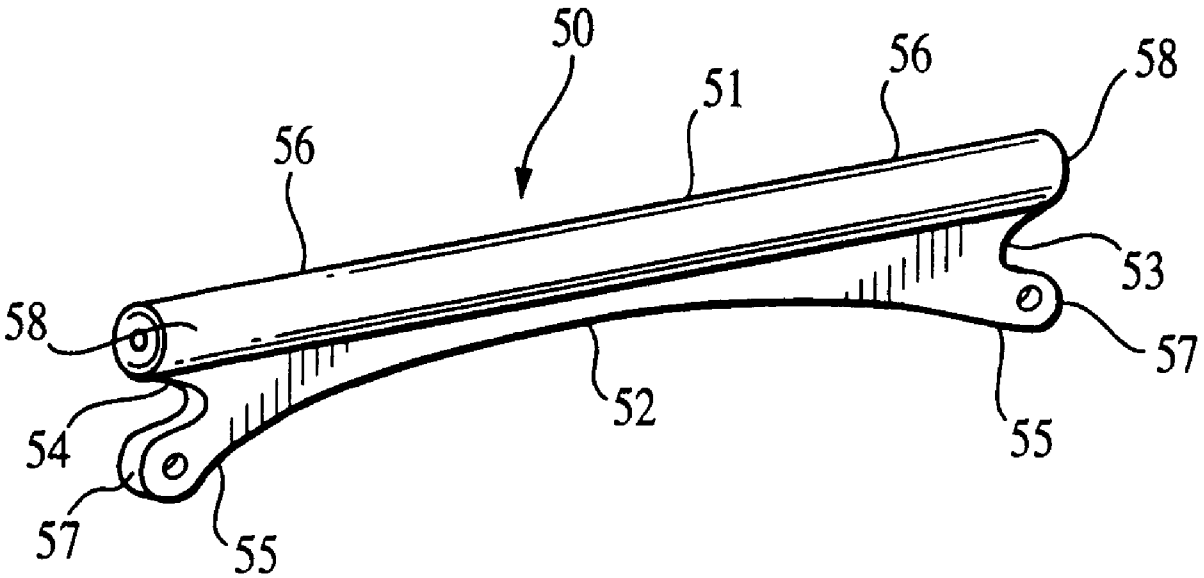
FIG. 5 is a side view of a base cross member.

As shown in FIG. 5, each base cross member 50 is one piece and has a tope end 51, a bottom end 52, and two side ends 53 and 54. Both side ends 53 and 54 split off into a bottom portion 55 and a top portion 56. For attaching to the workstation, both bottom portions 55 contain a horizontally running bolt-receiving hole 57, and both top portions 56 contain horizontally running sockets 58. Each base cross member is preferably aluminum but may also be a variety of materials including steel or plastic.

Figure 6:
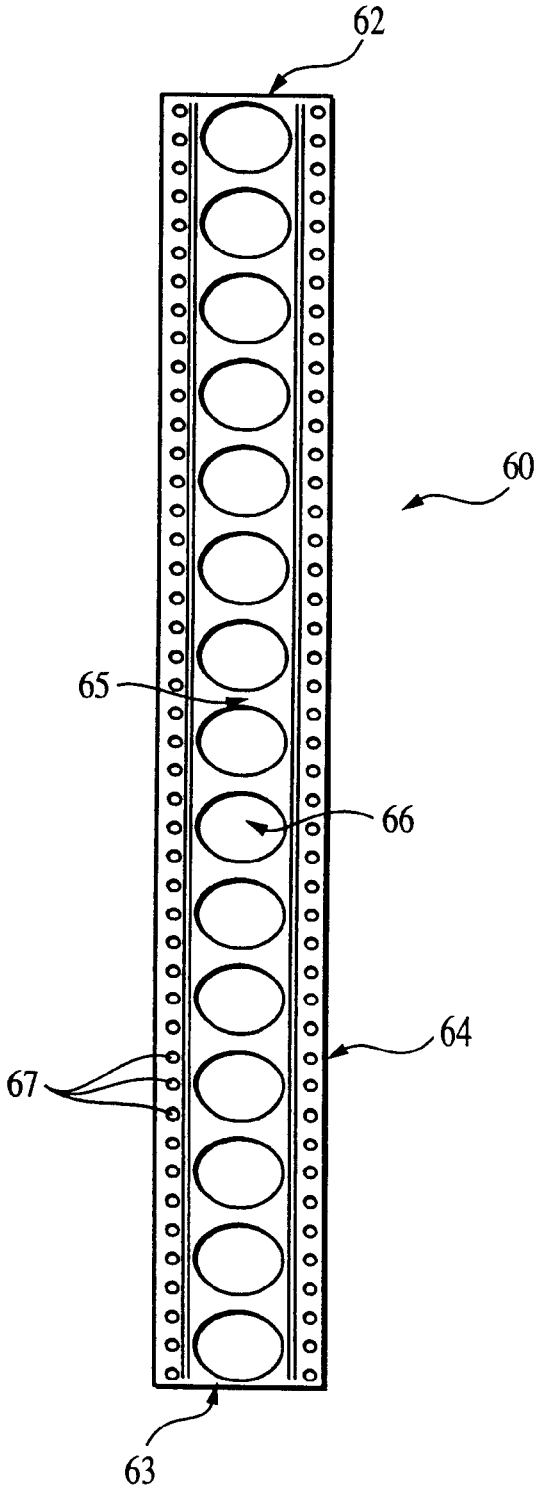
FIG. 6 is a side view of a support column.

Referring to FIG. 6, each vertically extending column 60 has an open top end 62, an open bottom end 63, and an outer surface extending around its periphery 64. A vertically extending open raceway channel 65 runs from the column's top end 62 to its bottom end 63. A plurality of horizontally running channels 66 running completely through the column from side to side are disposed vertically along the column. Such horizontally running channels 66 are preferably scalloped shaped on the periphery of the column. The open top end 62, open bottom end 63, open vertically extending raceway channel 65, and open horizontally running channels 66 allow for each wiring of the workstation. For allowing the attachment of various components to the column, including worksurfaces, support arms, support legs, and privacy screens, and any other article that requires support, the column also contains a plurality of horizontally extending bolt-receiving holes 67 disposed vertically along the column which allow for easy attachment of various workstation parts and accessories. Each column is preferably aluminum but may also be other materials such as steel or plastic.

Figure 7:
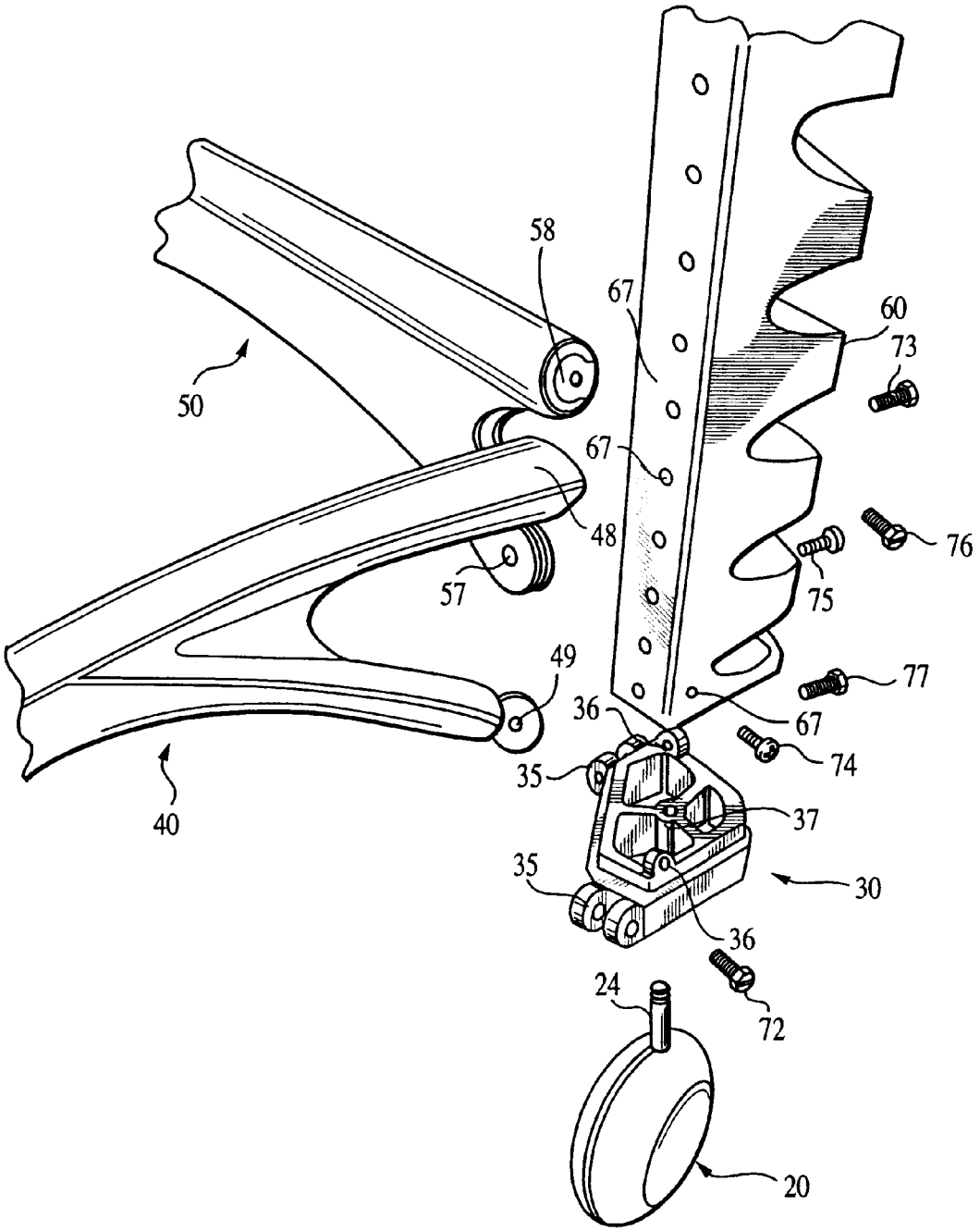
FIG. 7 is a perspective view showing the attachment of a wheel, ankle casting, foot, and base cross member to a support column.

As shown in FIG. 7, the stem 24 of the wheels 20 are threaded into each socket 37 running within each ankle casting 30 allowing attachment. A snap-fit connection may also be used. The feet 40 bolt to an ankle casting 30 by aligning a bolt-receiving hole 49 in a lower end of each foot between parallel aligned holes 35 in parallel outwardly extending segments at an end of the ankle casting 30 and running a bolt 72 through the three aligned holes thereby securing the foot to the ankle casting. The feet 40 bolt to a column 60 by running a bolt 73 through a bolt-receiving hole 67 of a column 60 into a bolt receiving socket 48 within a foot 40 where it is threadedly received. Each ankle casting 30 bolts to a column 60 by running bolts 74 and 75 through a separate bolt-receiving hole 67 of a column 60 into a separate threaded bolt-receiving segment 36 in the ankle casting 30. Each base cross member 50 bolts to a column 60 by running a bolt 76 through a bolt-receiving hole 67 of a column 60 into a bolt-receiving socket 58 within the base cross member 50 where it is threadedly received. Each base cross member 50 bolts to an ankle casting 30 by aligning a bolt-receiving hole 57 in a lower end of each base cross member between parallel aligned holes 35 in parallel outwardly extending segments at an end of the ankle casting 30 and running a bolt 77 through the three aligned holes thereby securing the base cross member to the ankle casting.

Figure 8:
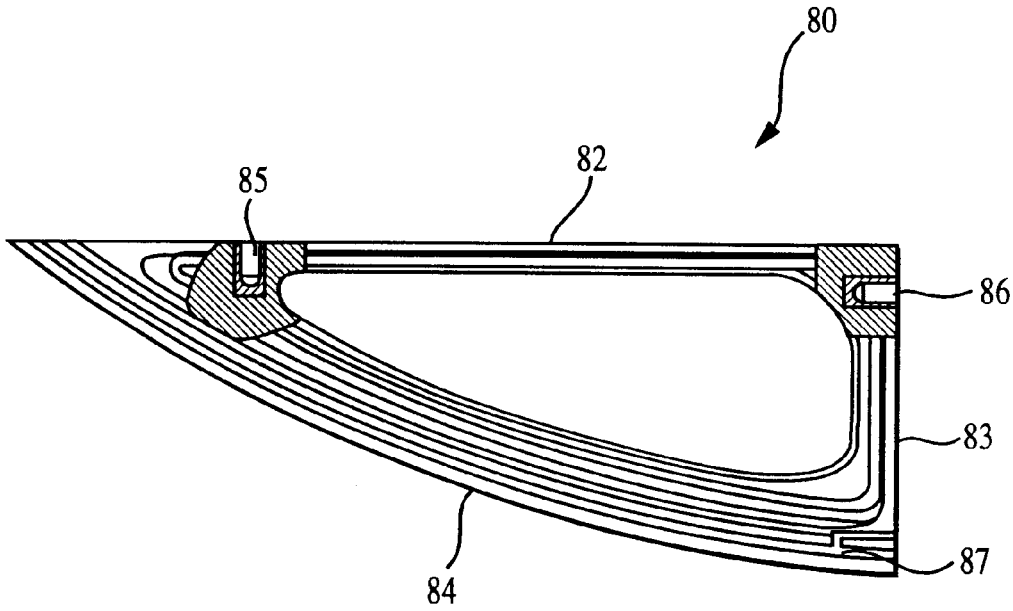
FIG. 8 is a side view of a workstation arm.

Referring to FIG. 8, each arm 80 is one piece and has a horizontal top end 82, a vertical side end 83, and a curved end 84. For attaching to the workstation, the top end 82 has a vertically running bolt-receiving socket 85 and the side end 83 has two horizontally running bolt-receiving sockets 86 and 87. Each arm is preferably aluminum but may also be a variety of other materials such as steel or plastic.

Figure 9:
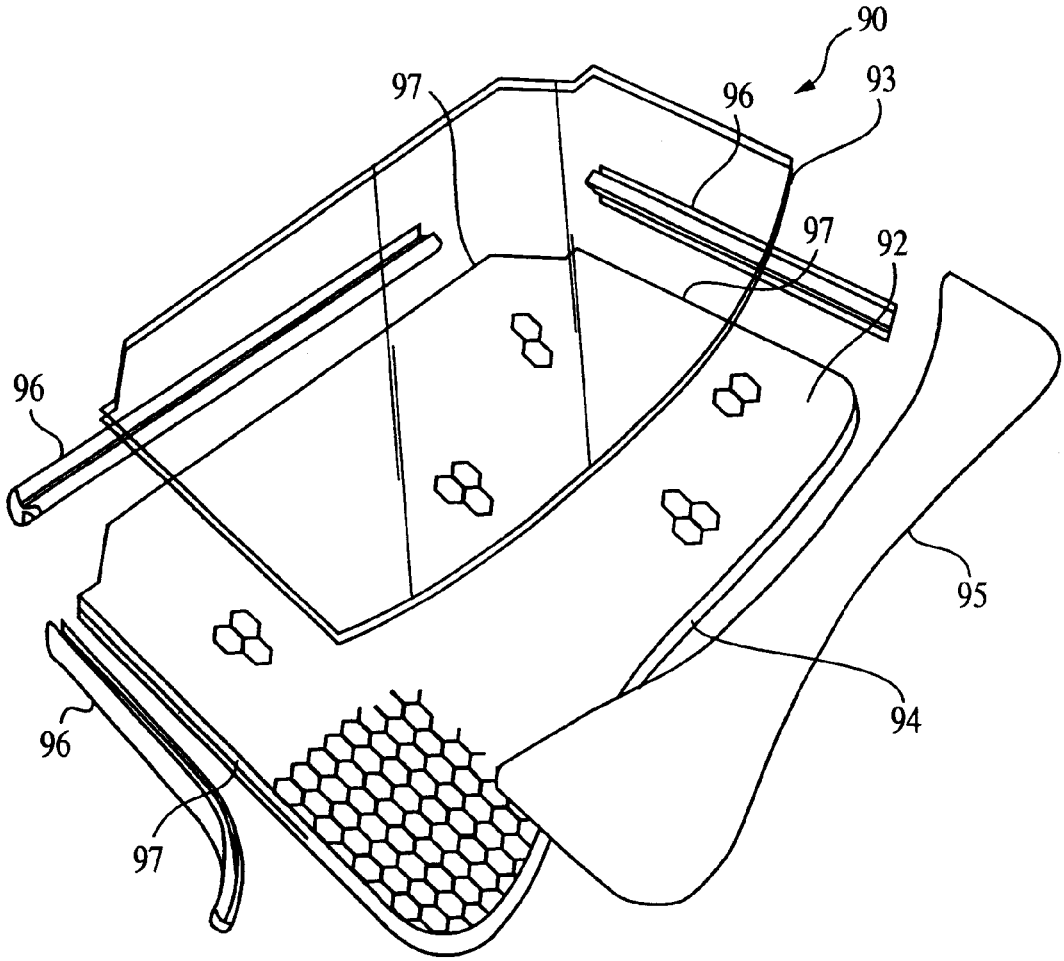
FIG. 9 is a perspective view of a workstation worksurface.

Shown in FIG. 9 is a possible construction for a light-weight semi-transparent worksurface 90. The construction shown has a one-piece pep core inner structure 92 which is generally rectangular and horizontally extending. Clear hard-coated preferably acrylic one-piece structures 93, which are generally rectangular and horizontally extending, are placed over the top and bottom of the one-piece pep core inner structure 92. The two structures are then joined together by inserting one end 94 of the combined two structures inside a rubber molded pocket 95 and then placing rubber T-molding members around the other three ends 97 of the combined two structures. In another embodiment, the two structures are joined together by inserting every end of the combined two structures inside rubber molded pockets 95 extending around the perimeter of the structures.

Figure 10:
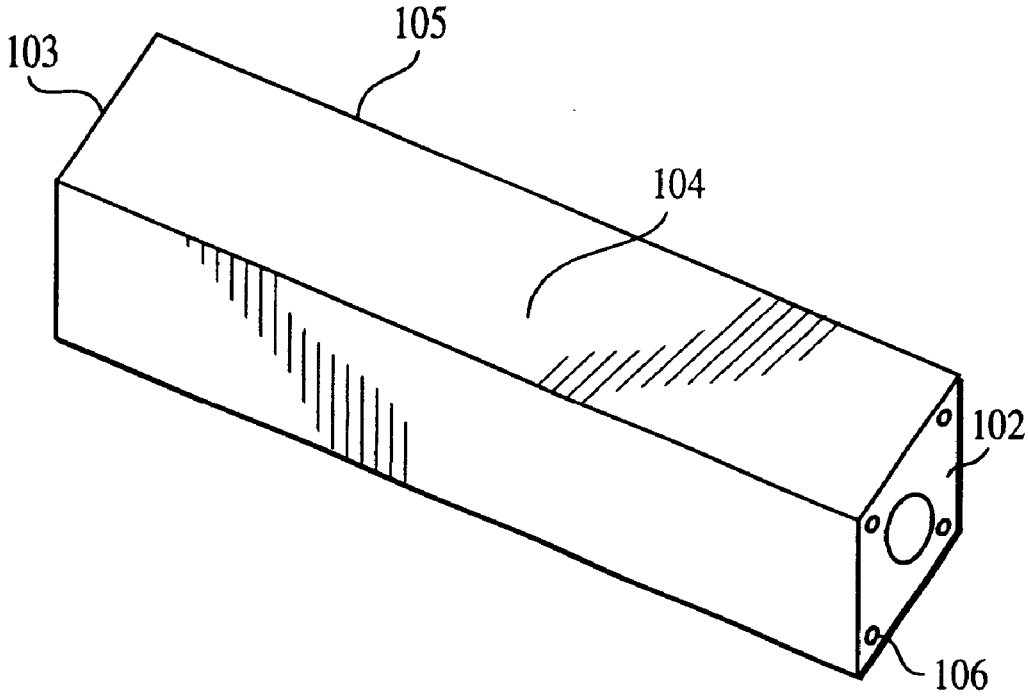
FIG. 10 is a perspective view of a workstation cable tray.

Referring to FIG. 10, the cable tray 100 is one-piece, rectangular, and horizontally extending. For wiring purposes, the tray 100 has partially open vertically extending side ends 102 and 103, an open interior channel 104 running within the tray 100 from one side end 102 to the other side end 103, and a partially open back end 105. For attaching to the workstation, bolt-receiving sockets or holes 106 are disposed in the side ends 102 and 103. Each cable tray is preferably steel but may also be other materials such as plastic and aluminum.

Figure 11:
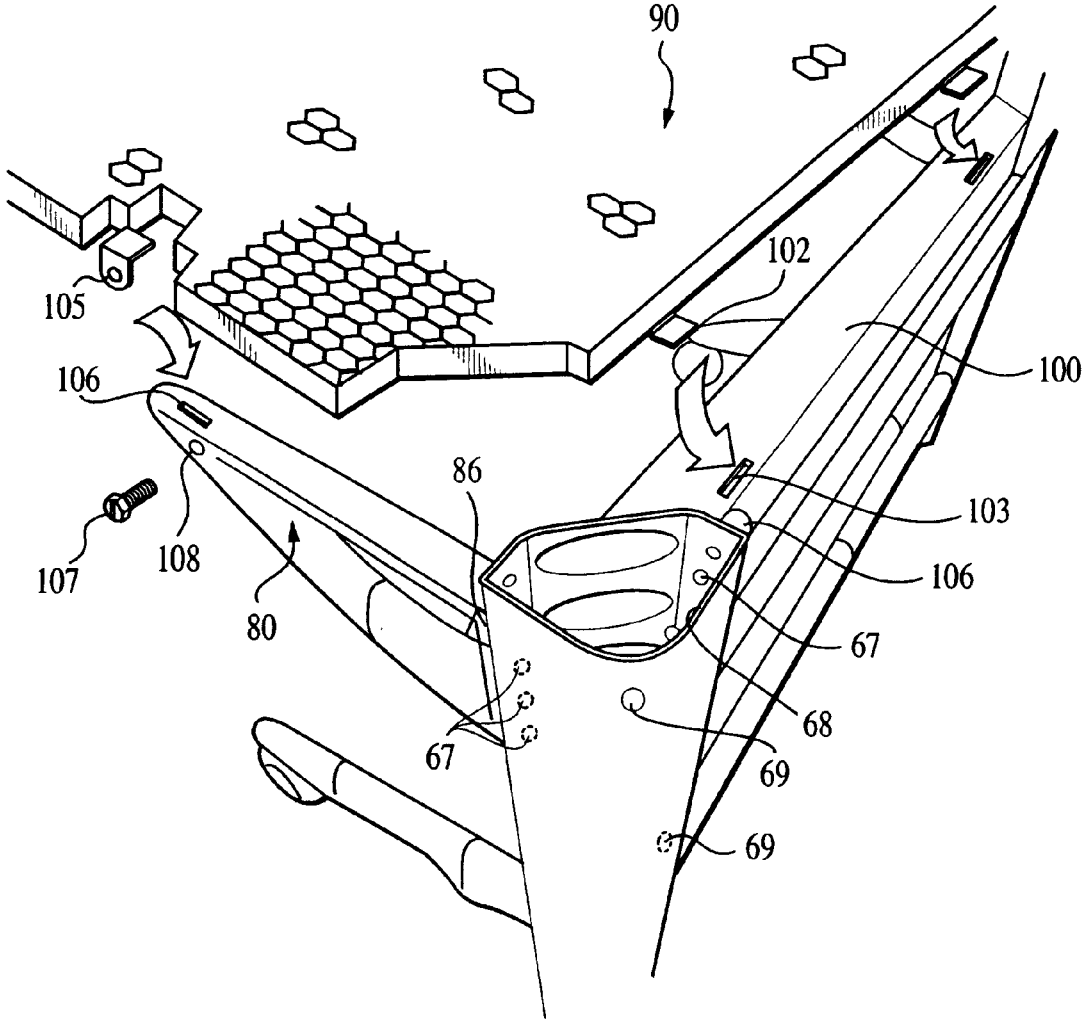
FIG. 11 is a perspective view showing the attachment of an arm and cable tray to a support column in addition to showing the attachment of a worksurface.

As shown in FIG. 11, in one embodiment each arm 80 is attached to a column 60 by threading a bolt 69 through a bolt-receiving hole 67 in the column 60 and into a bolt-receiving socket 86 in the arm 80. Each cable tray 100 is attached on each of its side ends to a column 60 by threading a bolt 68 through a bolt-receiving hole 67 in the column 60 and into a bolt-receiving socket 106 in the tray 100. A worksurface 90 is attached to the workstation by slipping back tabs 102 attached to the worksurface 90 into slots 103 in the top surface of the cable tray 100. The worksurface 90 is attached to the arm 80 by slipping a flange 105 attached to the worksurface 90 into a slot 106 in the top surface of the arm 80 and threading a bolt 107 through a bolt-receiving hole 108 in the arm 80 into a bolt-receiving hole in the flange 105. In another embodiment, the worksurface 90 is attached to the workstation by bolting the worksurface 90 to both the cable tray 100 and the arm 80 without the use of tabs, slots, or flanges.

Figure 12:
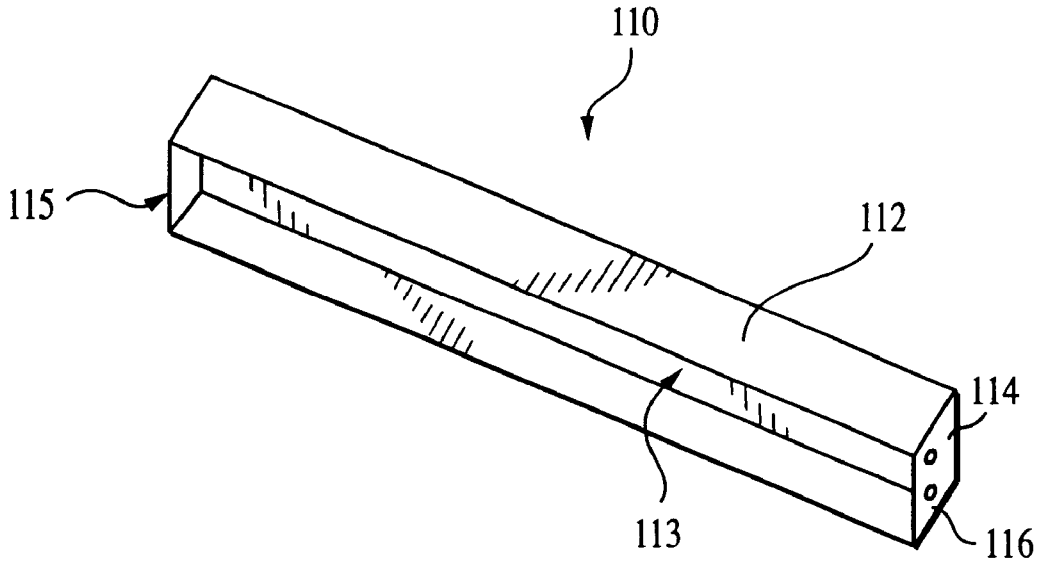
FIG. 12 is a perspective view of a workstation backing support member.

Referring to FIG. 12, each backing support member 110 is one-piece and has a horizontally running top surface 112, a vertically running back surface 113, and two vertically running side ends 114 and 115. For attaching to the workstation, bolt-receiving holes 116 are disposed in the side ends 114 and 115. Each backing support member is preferably aluminum but may be a variety of materials including plastic and steel.

Figure 13:
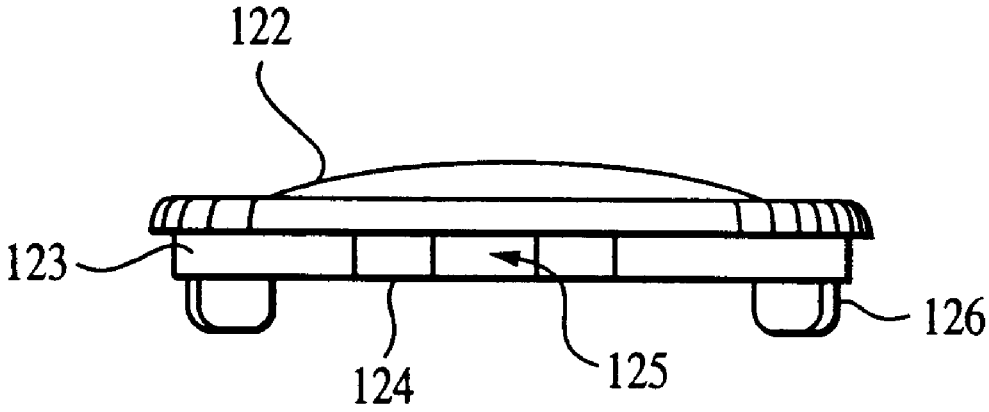
FIG. 13 is a top and side view of a workstation cap.
Figure 13:
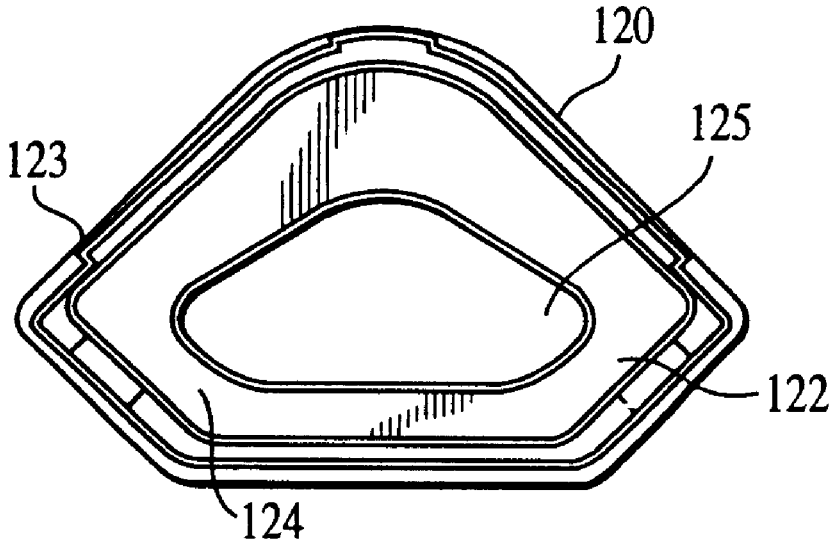

As seen in FIG. 13, each cap 120 is one-piece and has a horizontally running top surface 122, a vertically running side surface 123 disposed around the periphery of the cap, and a horizontally running bottom surface 124. For wiring and handling purposes, a vertically running open channel 125 runs from the top surface 122 through the bottom surface 124. For attaching the cap to the workstation, snap-fit tabs 126 are disposed around the cap's bottom surface. The cap is preferably aluminum but may be a variety of other materials including plastic and steel.

Figure 14:
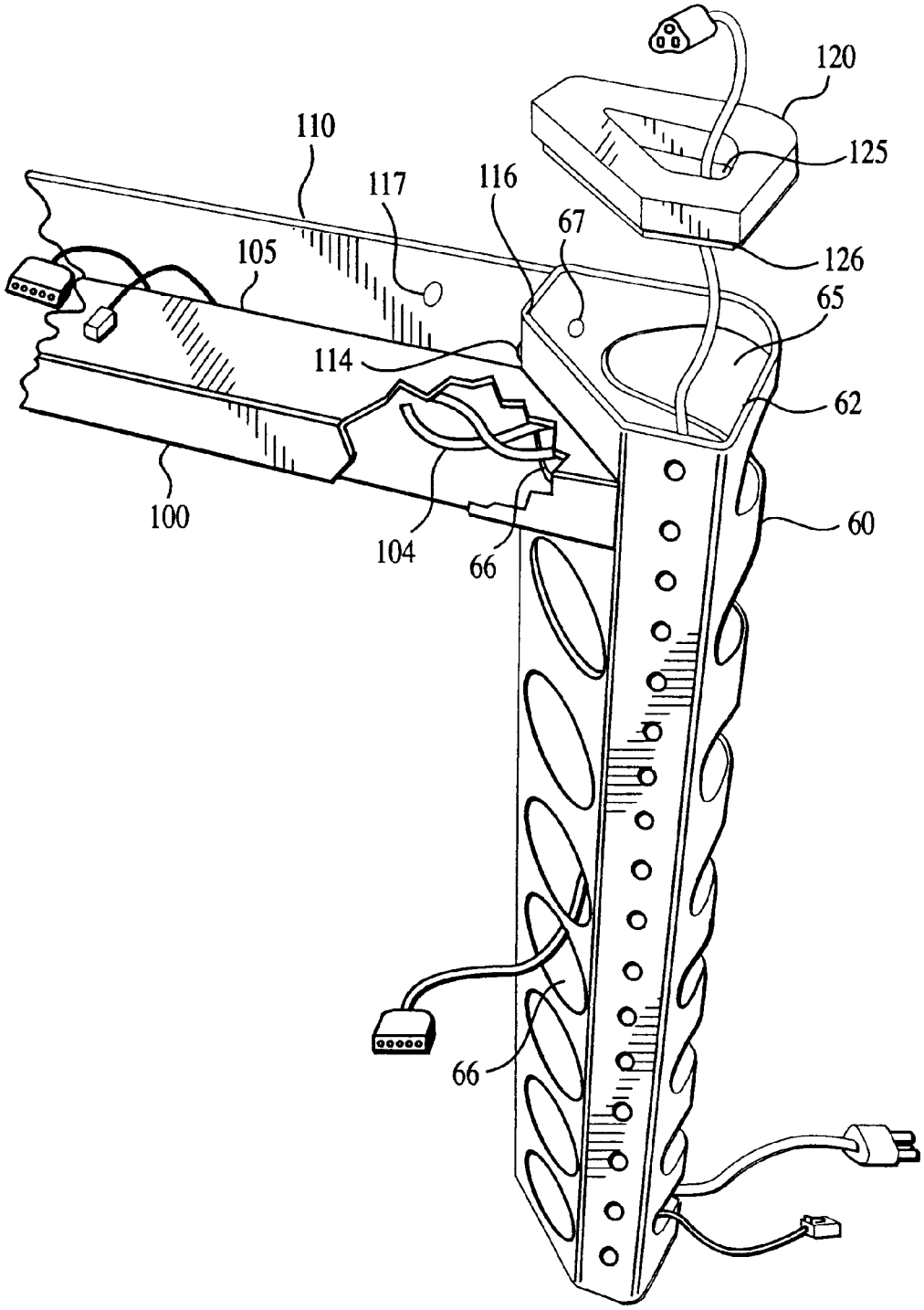
FIG. 14 is a perspective view showing the attachment of a backing support member and a cap to a support column in addition to showing wiring access and a cap handle.

Referring to FIG. 14, the backing support member 110 is attached to the column 60 by threading a bolt 117 into a bolt-receiving hole 116 in a side end 114 of the support member through a bolt-receiving hole 67 in the column. The cap 120 is attached to the top end of the column 62 by snap-fitting the tabs 126 in the cap inside the inner surface of the column. The vertically running open channel 125 in the cap 120 allows the workstation to be easily moved by providing a grip within which a hand can be reached. Wiring may be run into the column 60 through the horizontally open running channels 66. It should be understood that the term "wiring" as used herein includes, but is not limited to, various electrical wires, communication lines, and data cables, whether electrical, optical or co-axial. Such wiring may be run up and down the column 60 through the vertically extending interior open raceway channel 65. Wiring may also be run through the vertically running open channel 125 in the cap 120 into the raceway channel 65 of the column 60. Further, wiring may be run into the cable tray 100 through the partially open back end 105 of the tray, through the open interior channel 104 running within the tray, and into the column 60 through the horizontally open running channels 66 within the column.

Figure 15:
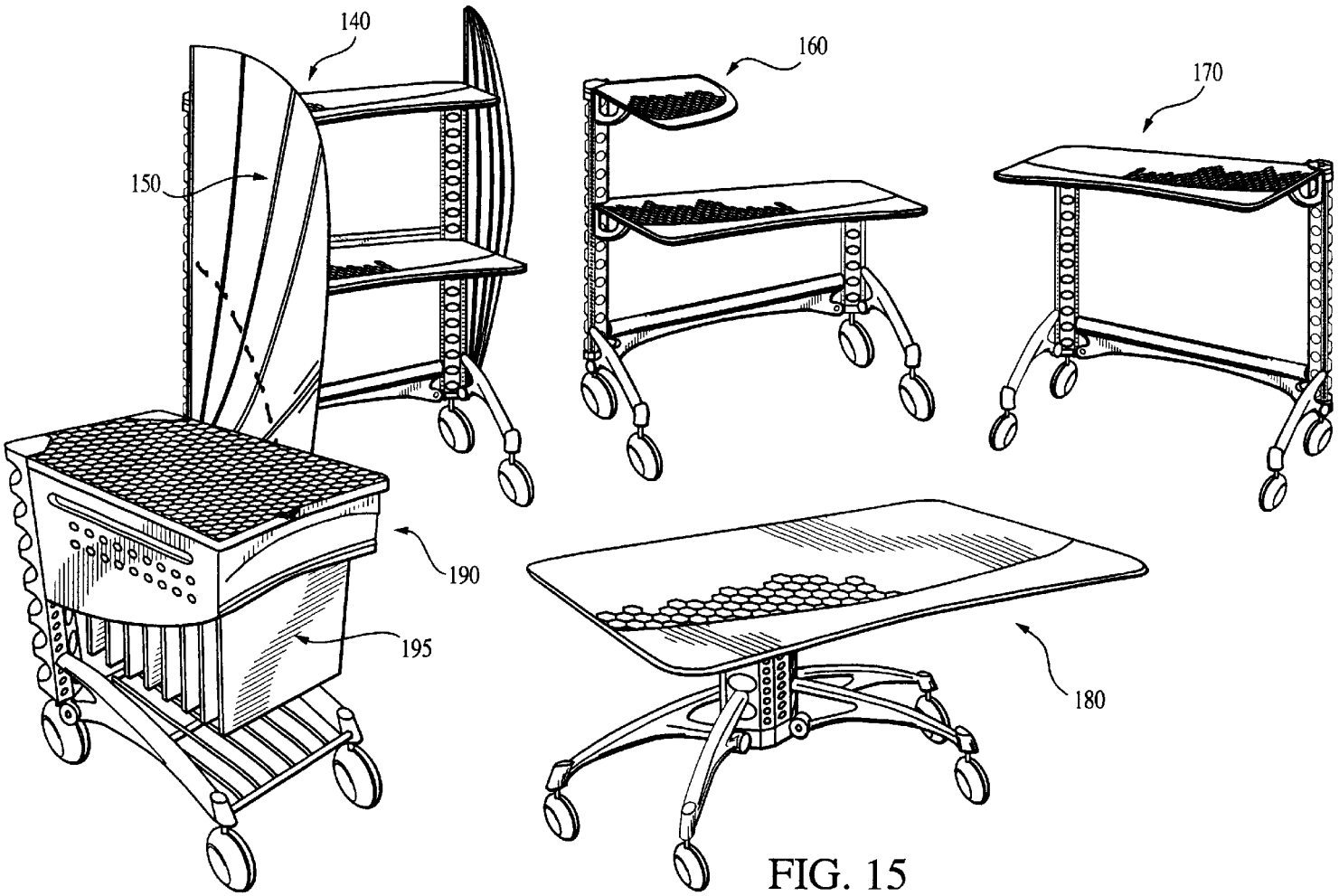
FIG. 15 is a perspective view showing the workstation kit's modularity and reconfiguration capabilities.
Figure 16:
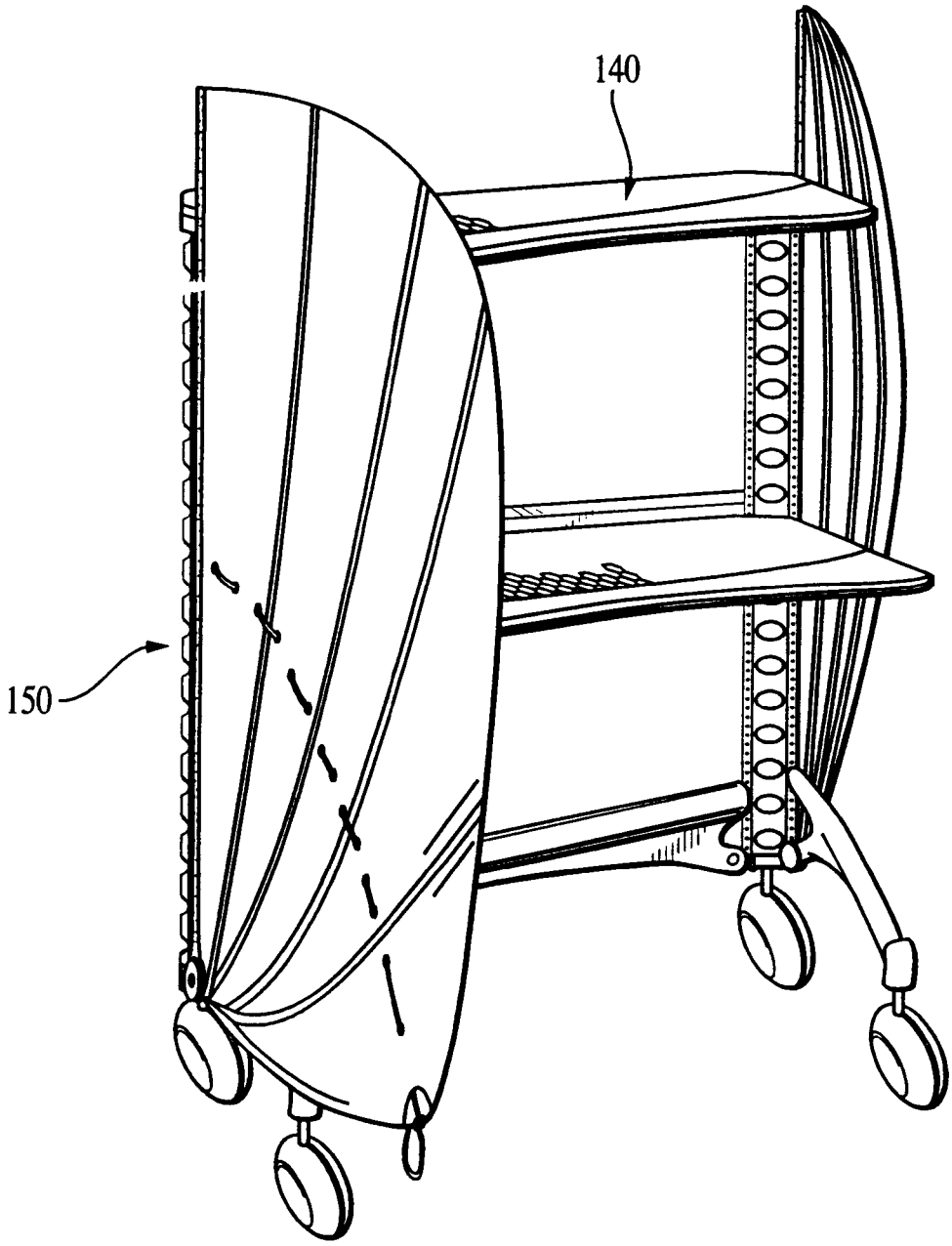
FIG. 16 is a perspective view of one possible configuration of the workstation kit.
Figure 17:
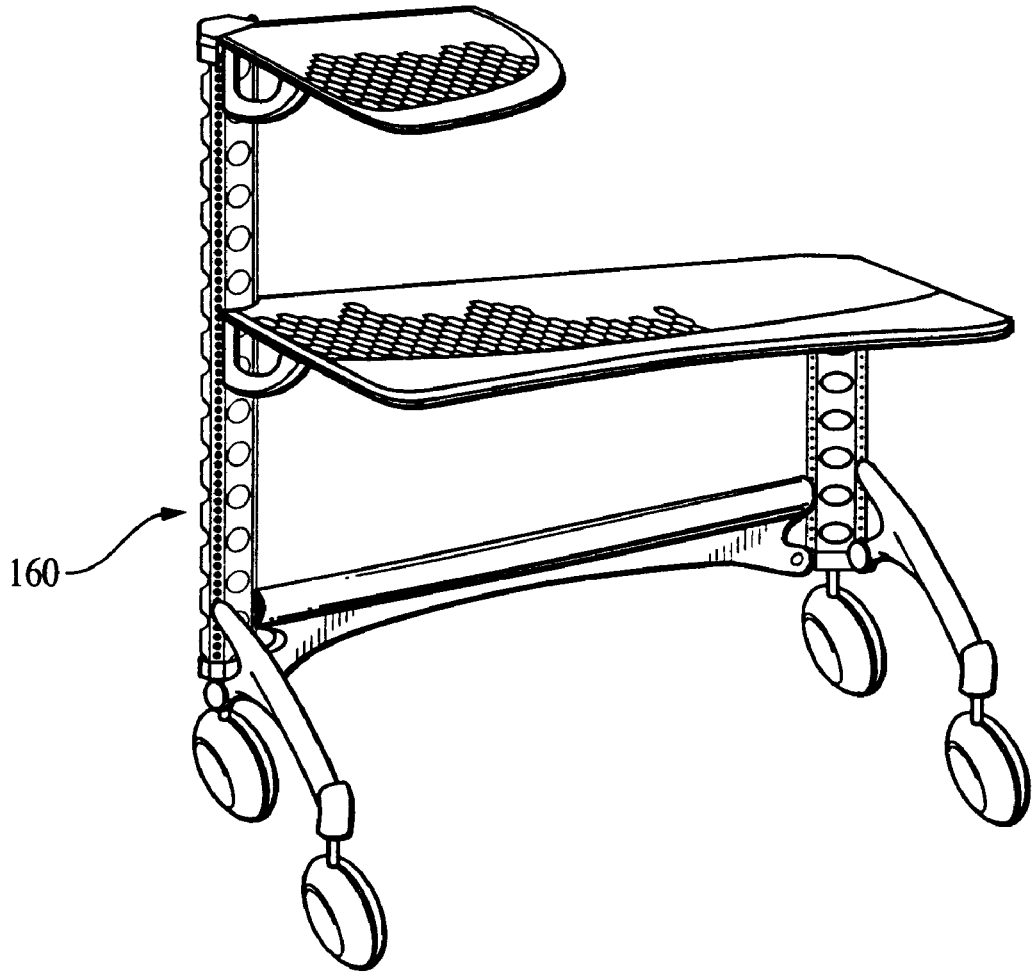
FIG. 17 is a perspective view of a second possible configuration of the workstation kit.
Figure 18:
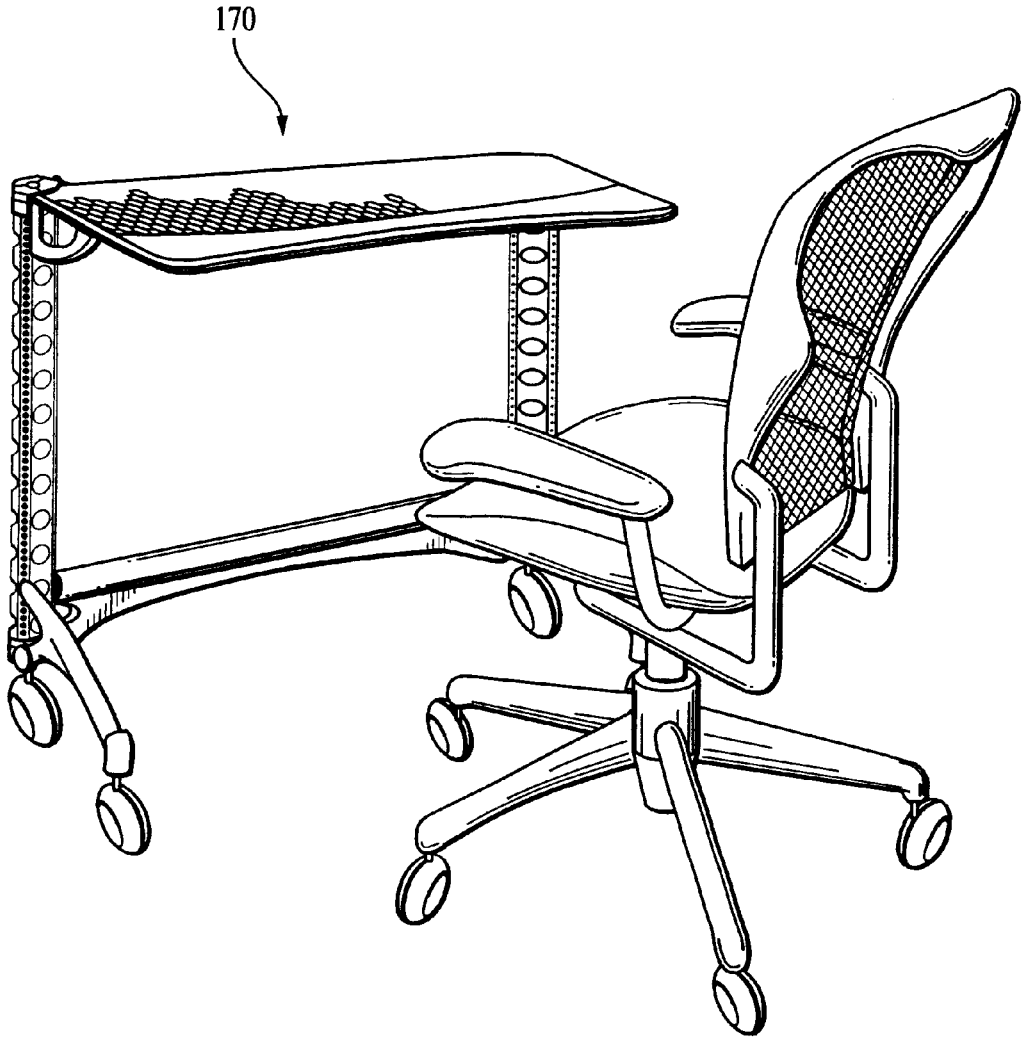
FIG. 18 is a perspective view of a third possible configuration of the workstation kit.
Figure 19:
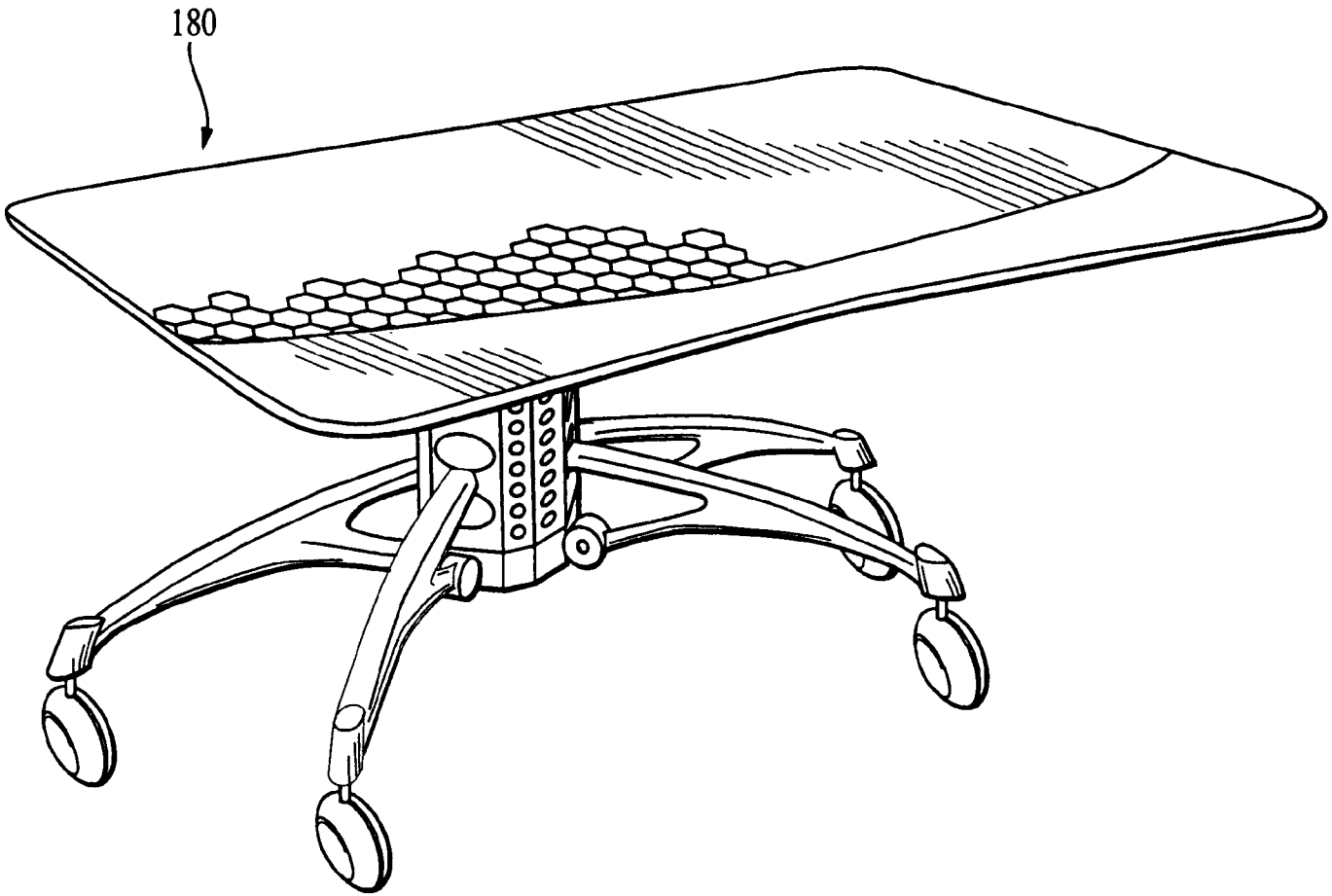
FIG. 19 is a perspective view of a fourth possible configuration of the workstation kit.
Figure 20:
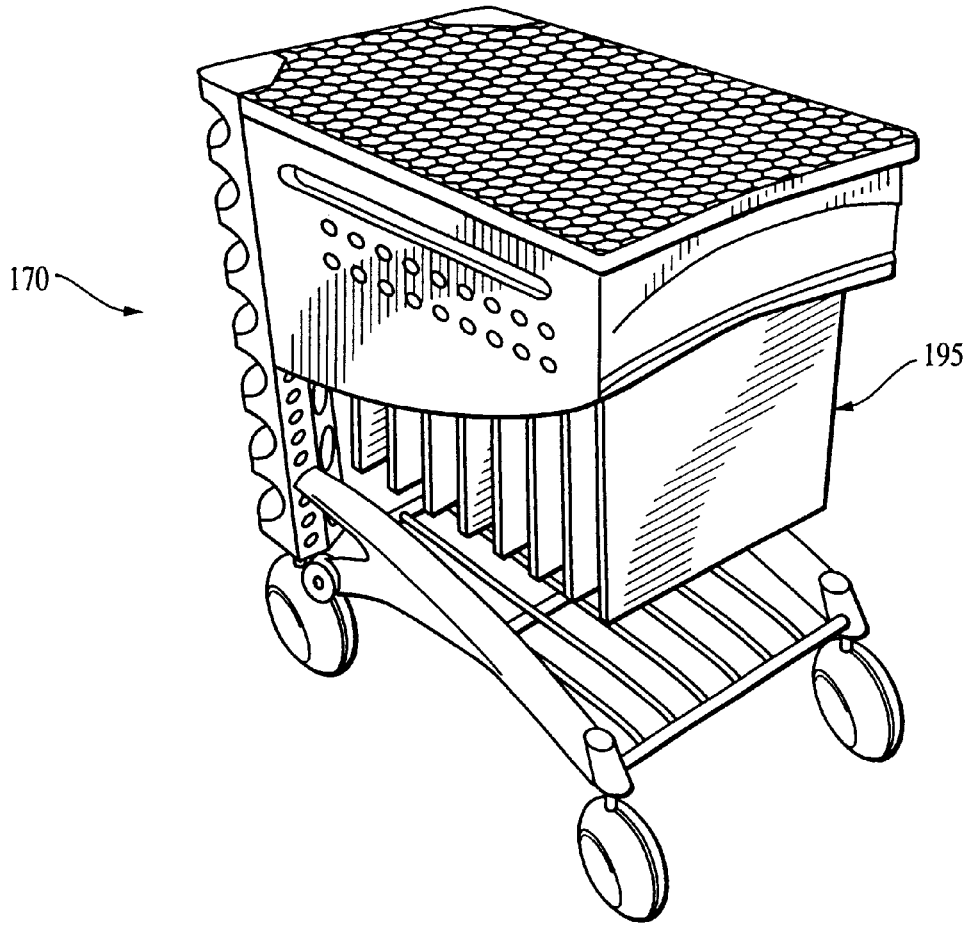
FIG. 20 is a perspective view of a fifth possible configuration of the workstation kit.

As shown in FIG. 15, a primary advantage of the instant invention is its modularity and reconfiguration capabilities. The invention described is kit-like and has inter-changeable parts that can be re-arranged to form differently configured workstations. Five different configurations are shown in FIG. 15 using the same or similar parts in different positions. A two column, two worksurface, workstation is shown as 140. Note the addition of an additional accessory comprising a retractable screen 150 which will be discussed in greater detail below. Shown as 160 is a workstation having two differently sized columns, and two differently sized worksurfaces. Shown as 170 is a workstation having two columns and only one worksurface. Shown as 180 is a workstation having one column and one worksurface. Finally, shown as 190 is a workstation having two columns, one worksurface, and the addition of a filing cabinet 195. It is to be appreciated that any number of possible configurations exist by simply re-configuring the varying parts.

Referring to FIGS. 16–20, individual close-up drawings of the five different configurations shown in FIG. 15 and discussed above are set forth.

Figure 21:
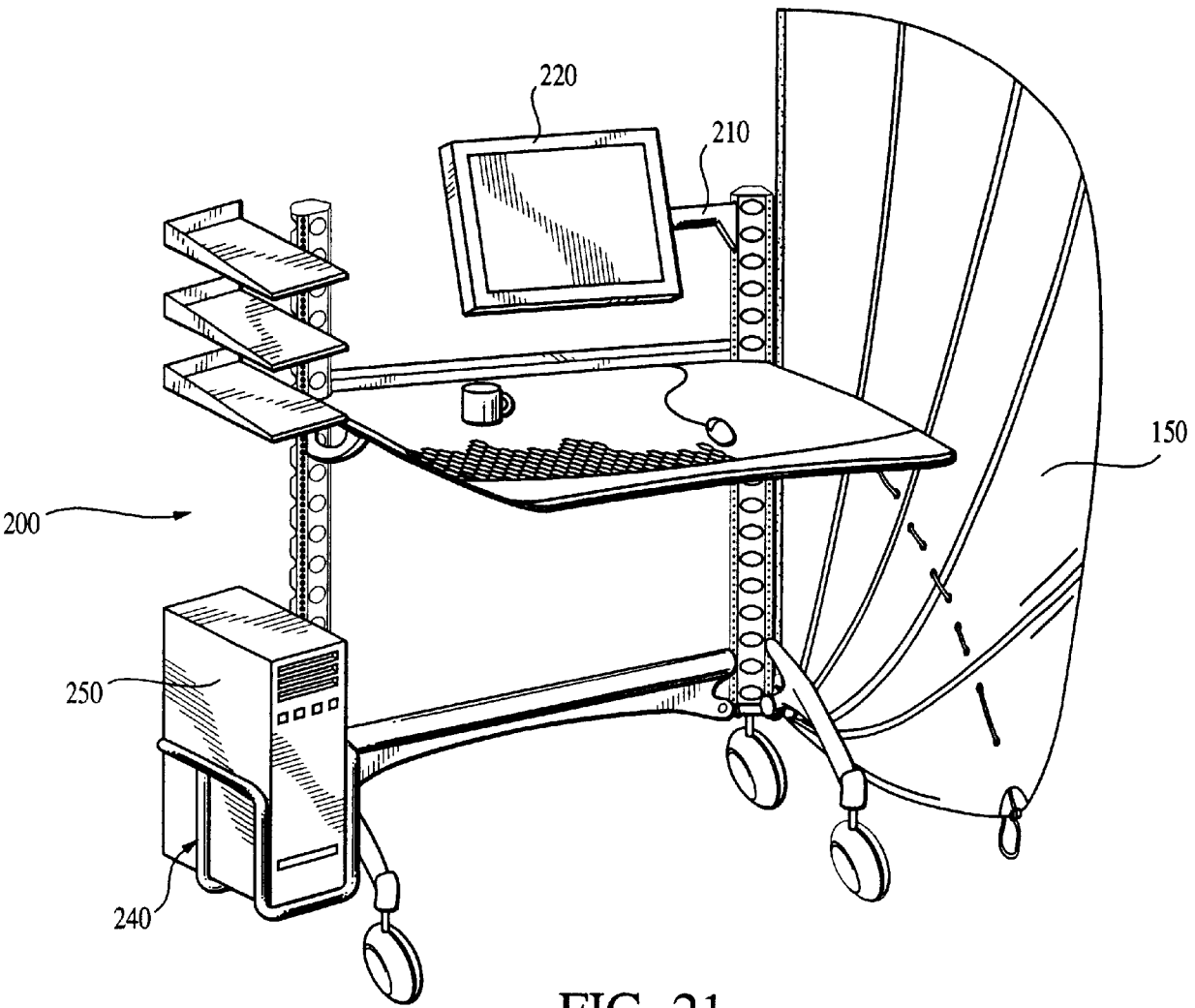
FIG. 21 is a perspective view of a sixth possible configuration of the workstation kit.

As shown in FIG. 21, another possible configuration is disclosed 200 having two columns and one worksurface. Additional accessories are also disclosed including a retractable screen 150, a computer monitor holder 210, a computer monitor 220, a tray holder 230, a CPU holder 240, and a CPU 250.

Figure 22:
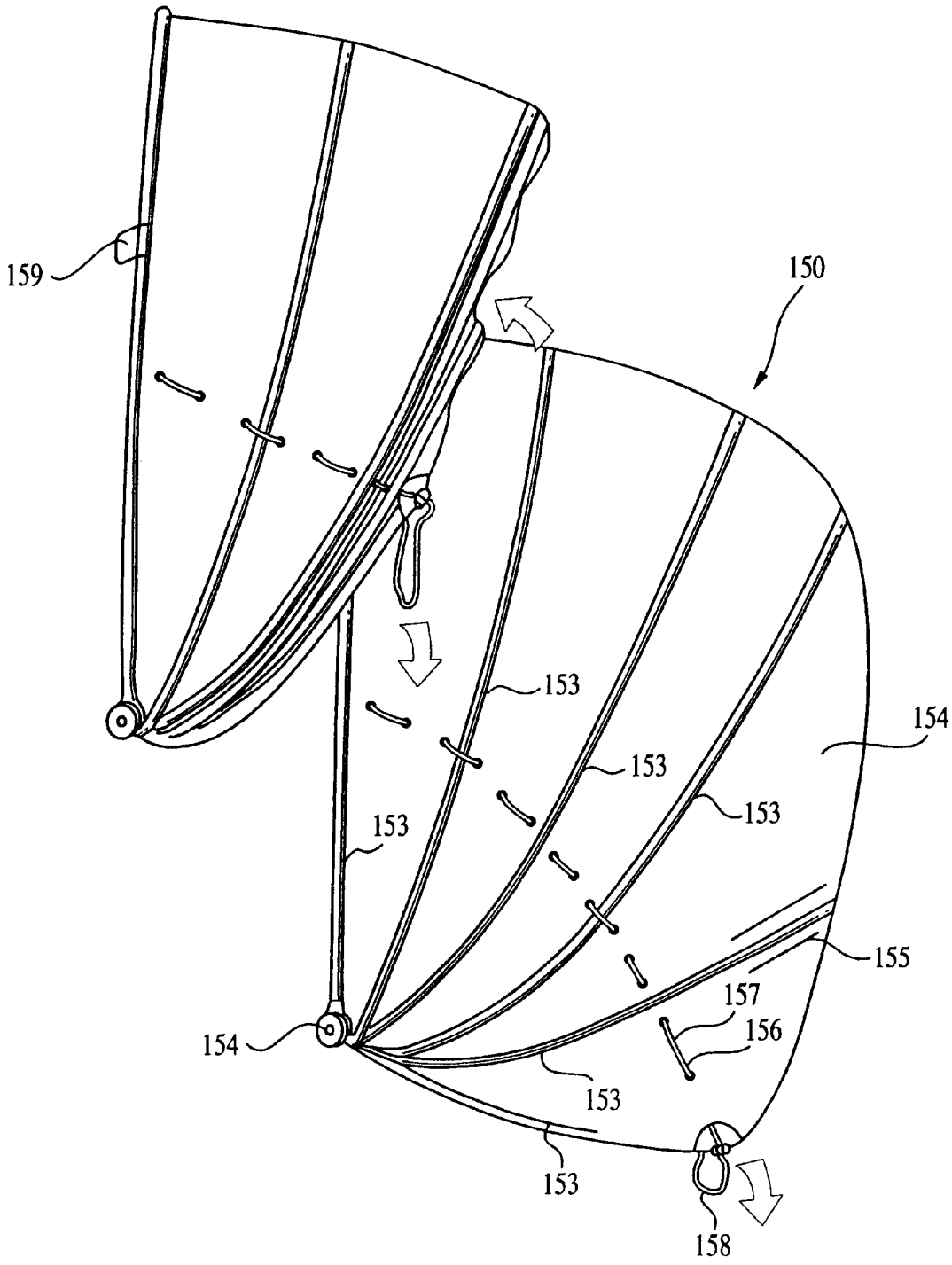
FIG. 22 is a side view of a retractable privacy screen.

Referring to FIG. 22, a retractable screen accessory 150 is shown in greater detail. The screen 150 has a plurality of flexible individual frame members 153 which pivot around a hinge 154 allowing retraction of the screen. The screen itself 154, which is preferably cloth but may be a number of materials, is attached to the frame members 153 by inserting each frame member 153 into a separately sewn pocket 155 in the screen. To allow for easy retraction, a rip-cord 156 runs through holes 157 in the screen itself, and has a looped handle 158. A bracket 159 is attached to an end frame member for attaching the screen to a workstation. The bracket is preferable steel but could be plastic.

Figure 23:
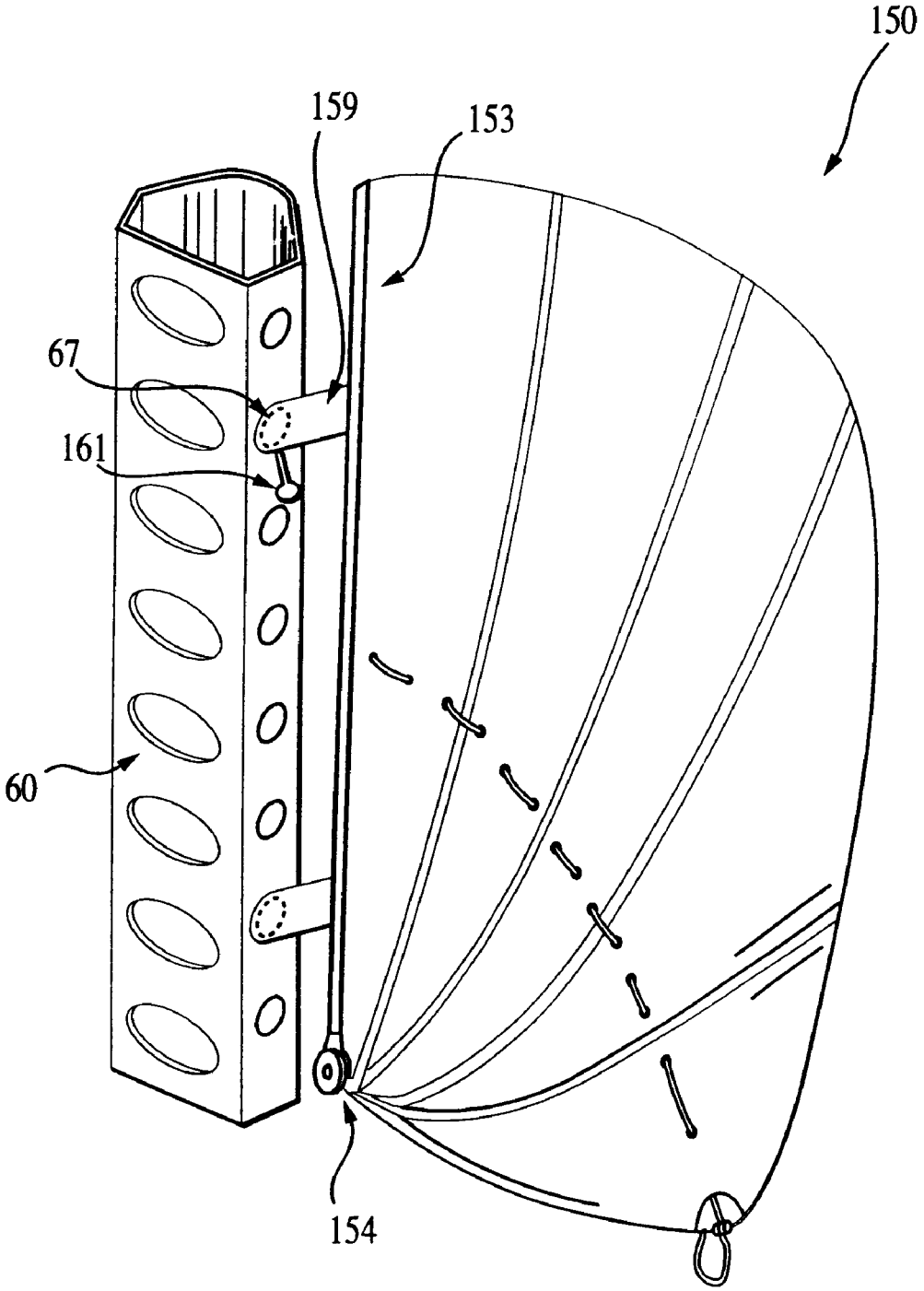
FIG. 23 is a perspective view showing the attachment of a retractable privacy screen to a support column.

As shown in FIG. 23, in one embodiment the screen 150 is attached to a column 60 by aligning an end frame 153 with the column and inserting a bolt 161 into a bracket 159 attached to the frame 153 and threading it through a bolt-receiving hole 67 within the column 60. For stability purposes, more than one connection may be required Although the present invention has been described with reference to preferred embodiments, those skilled in the art will recognize that changes may be made in form and detail without departing from the spirit and scope of the invention. As such, it is intended that the foregoing detailed description be regarded as illustrative rather than limiting and that it is the appended claims, including all equivalents thereof, which are intended to define the scope of the invention.

What is claimed is:

1. A workstation comprising:

a workstation component comprising at least one support foot, at least one support arm, and at least one worksurface component, wherein said worksurface component is supported by said at least one support arm;

an elongated and vertically extending support column, wherein said at least one support foot and said at least one support arm are attached to said support column and extend laterally from said support column, said support column having a substantially hollow portion defining an interior cavity and a plurality of openings communicating between an exterior of said column and said interior cavity, wherein said plurality of openings are formed vertically along at least a portion of a length of said column, wherein said openings are accessible to a user and adapted to receive wiring, and wherein said plurality of openings within said support column are adapted to receive at least a portion of an end of one or more of said at least one support foot, said at least one support arm, and said at least one worksurface component by inserting said portion of said end into one of said plurality of openings so that said portion of said end abuts against an interior surface of said opening.

2. The invention of claim 1 wherein said column comprises an inner side and an outer side, said outer side being at least partially curved and at least partially linear, each of said inner and outer sides having said openings.

3. The invention of claim 2 wherein said components are attached to the linear portion of said outer side and said openings are in the curved portion of said outer side.

4. The invention of claim 1 wherein said openings are curved.

5. The invention of claim 1 wherein said openings are scalloped.

6. The invention of claim 1 further comprising:

a plurality of wheels attached with said support column.

7. The invention of claim 1 wherein said interior cavity defines at least one raceway therein adapted to receive utilities within said support column.

8. The invention of claim 7 wherein said plurality of openings within said support column are adapted to receive said utilities allowing for access to said at least one raceway.

9. A workstation comprising:

a workstation component comprising at least one worksurface;

an elongated and vertically extending support column attached to said workstation component, said support column having a substantially hollow portion defining an interior cavity and a plurality of openings communicating between an exterior of said column and said interior cavity, wherein said interior cavity defines at least one raceway therein adapted to receive utilities within said support column, wherein said plurality of openings are formed vertically along at least a portion of a length of said column, wherein said openings are accessible to a user and adapted to receive wiring and said utilities allowing for access to said at least one raceway, and wherein said plurality of openings within said support column are adapted to receive at least a portion of an end of said workstation component by inserting said portion of said end of said workstation component into one of said plurality of openings so that said portion of said end of said workstation component abuts against an interior surface of said opening.

10. The invention of claim 9 wherein said support column defines a plurality of holes, said plurality of holes are adapted to attach at least one support arm to said column, the positioning of said plurality of holes allowing for attachment of said at least one worksurface to said support column in a variety of configurations.

11. The invention of claim 10 wherein said support column has a partially open top end and at least one cap attached to said partially open top end.

12. The invention of claim 11 wherein said at least one cap has at least one opening shaped to allow a user to grasp said cap by allowing the user to insert part of a hand into said opening of said cap to grasp said cap.

13. The invention of claim 1 wherein said workstation component comprises at least one screen attached to said support column.

14. The invention of claim 13 wherein said at least one screen is retractable.

15. The invention of claim 1 further comprising:

at least two of said support columns; and at least one support member attached to said at least two support columns, allowing for the configuration of a workstation having multiple support columns, each of said support columns being adapted to support said at least one worksurface in a variety of positions, allowing for a variety of workstation configurations.

16. A workstation comprising:

a workstation component;

an elongated and vertically extending support column attached to said workstation component, said support column having a partially open top end; and a cap attached to said partially open top end, wherein said cap has an opening formed therethrough, said opening adapted to receive wiring by inserting said wiring into said opening, and said opening also adapted to act as a handle by allowing a user to insert part of a hand into said opening of said cap to grasp onto said cap.

17. The invention of claim 16 wherein said cap is attached to said partially open top end of said support column by a snap fit.

18. A workstation comprising:

a workstation component;

an elongated and vertically extending support column attached to said workstation component; and at least one retractable privacy screen attached to said support column, wherein said at least one retractable privacy screen comprises a sheet material web, and a plurality of frame members, wherein each of said frame members comprises a distal end and a proximal end, wherein said proximal ends are coaxially attached, wherein said sheet material web is attached to said frame members, and wherein at least two of said distal ends of at least two of said plurality of frame members are adapted to simultaneously rotate towards each other in a same plane.

19. The invention of claim 18 wherein said retractable privacy screen is attached to said support column with a bracket.

20. The invention of claim 18 wherein said proximal ends are coaxially attached about a hinged axis.

21. A kit having components capable of being assembled as a workstation, the kit comprising:

at least one support column defined by a plurality of openings formed vertically along at least a portion of said column;

at least one support foot adapted to be attached to said at least one support column;

at least one support arm adapted to be attached to said at least one support column;

at least one worksurface adapted to be attached to said at least one support arm, wherein said plurality of openings in said support column are adapted to receive at least a portion of an end of said worksurface by inserting said portion of said end of said worksurface into one of said plurality of openings so that said portion of said end of said worksurface abuts against an interior surface of said opening, and wherein said at least one support column, said at least one support foot, said at least one support arm, and said at least one worksurface are capable of being configured in a plurality of workstation alignments having a varying number of support columns, support feet, support arms, and worksurfaces arranged in a variety of positions.

22. The invention of claim 21 further comprising:

at least two of said support columns; and at least one support member adapted to extend between said at least two support columns.

23. A method of reconfiguring a workstation kit comprising:

providing a workstation comprising at least one support column defined by a plurality of openings formed vertically along at least a portion of said column; and at least one worksurface;

inserting a portion of an end of said at least one worksurface into one of said plurality of openings so that said portion of said end of said worksurface abuts against an interior surface of said opening;

un-inserting said portion of said end of said worksurface from said opening; and inserting said portion of said end of said worksurface into another of said plurality of openings so that said portion of said end of said worksurface abuts against an interior surface of said another opening.

24. The invention of claim 23 wherein said provided workstation further comprises:

at least two of said support columns; and at least one support member extending between said at least two support columns, said support member having opposite ends attached to said support columns at a first position.

25. The invention of claim 24 wherein said method of reconfiguring a workstation further comprises:

detaching each end of said at least one support member from said support columns at said first position; and reattaching each end of said at least one support member to said separate support columns at a second position to form a second workstation configuration.

26. A method of wiring a workstation comprising:

providing a workstation comprising a workstation component comprising at least one support foot, at least one support arm, and at least one worksurface component, wherein said worksurface component is supported by said at least one support arm; and at least one elongated and vertically extending support columns, wherein said at least one support foot and said at least one support arm are attached to said support column and extend laterally from said support column, said support column having a substantially hollow portion defining an interior raceway, and having a plurality of vertically spaced openings formed along at least a portion of said column, said openings extending within said hollow portion of said support column, said plurality of openings within said hollow support column adapted to receive wiring allowing easy wiring access to said at least one raceway, said at least one raceway adapted to receive wiring running within said hollow support column;

inserting wiring into one of said plurality of openings formed within said support column;

running said wiring through said at least one raceway formed within said support column; and pulling said wiring through another of said plurality of openings within said support column.

27. A method of deploying a retractable privacy screen to a workstation comprising:

providing a workstation comprising a workstation component; an elongated and vertically extending support column attached to said workstation component; and at least one retractable privacy screen attached to said support column in a folded up position, wherein said at least one retractable privacy screen comprises a sheet material web, and a plurality of frame members, wherein each of said frame members comprises a distal end and a proximal end, wherein said proximal ends are coaxially attached, and wherein said sheet material web is attached to said frame members; and extending said at least one retractable privacy screen from a folded up position to a folded down position by simultaneously rotating at least two of said distal ends of at least two of said plurality of said frame members towards each other in a same plane; and disextending said at least one screen from a folded down position to a folded up position by simultaneously rotating at least two of said distal ends of at least two of said plurality of said frame members away from each other in a same plane.

28. The invention of claim 27 wherein said extending and disextending comprises pivoting said frame members about a hinged axis.

29. A method of moving a workstation comprising:

providing a workstation comprising: at least one hollow support column, said at least one support column defined by a partially opened top end; at least one cap defined by at least one opening within said at least one cap, said at least one cap attached to said partially open top end of said at least one support column, said at least one opening within said at least one cap adapted to act as a handle by allowing a user to insert part of a hand into said opening of said cap to grasp onto said cap;

gripping said cap with a user's hand by inserting said hand through said at least one opening within said at least one cap; and moving said workstation from a first location to a second location.

* * * * *